US005078297A

United States Patent [19]

Howard et al.

[11] Patent Number: 5,078,297

[45] Date of Patent: Jan. 7, 1992

[54] PARTITIONED WASTE BASKET

[76] Inventors: Frank C. Howard, 1646 Barberry La., Mt. Prospect, Ill. 60056; Mohamed K. Wagdy, 818 Kingsley Dr., Arlington Heights, Ill. 60004; Robert F. Murray, 1025 S. Pine Ave., Arlington Heights, Ill. 60005

[21] Appl. No.: 641,055

[22] Filed: Jan. 14, 1991

[51] Int. Cl.[5] ..... B65F 1/06; B65D 25/06

[52] U.S. Cl. ..... 220/533; 220/532; 220/526; 220/404; 220/338

[58] Field of Search ..... 220/909, 404, 532, 533, 220/524, 526, 338, 653, 671, 675

[56] References Cited

U.S. PATENT DOCUMENTS

| | | | |
|---|---|---|---|
| 2,645,127 | 7/1953 | Parks | 220/532 |
| 2,747,388 | 5/1956 | Dolar | 220/524 |
| 4,577,773 | 3/1986 | Bitel | 220/533 |
| 4,593,816 | 6/1986 | Langenbeck | 206/518 |
| 4,750,638 | 6/1988 | Sosower | 220/404 |
| 4,826,013 | 5/1989 | Heikkinen | 206/518 |
| 4,834,262 | 5/1989 | Reed | 220/532 |
| 4,867,328 | 9/1989 | McCarthy | 220/404 |
| 4,905,853 | 3/1990 | Strawder | 220/404 |
| 4,940,159 | 7/1990 | Callas et al. | 220/404 |
| 4,974,746 | 12/1990 | Dickinson | 220/404 |

FOREIGN PATENT DOCUMENTS

| | | | |
|---|---|---|---|
| 3636019 | 4/1988 | Fed. Rep. of Germany | 220/909 |
| 3642734 | 6/1988 | Fed. Rep. of Germany | 220/909 |
| 3703557 | 8/1988 | Fed. Rep. of Germany | 220/909 |

*Primary Examiner*—Stephen Marcus
*Assistant Examiner*—S. Castellano
*Attorney, Agent, or Firm*—Charles F. Lind

[57] ABSTRACT

The disclosed partitioned wastebasket has component pieces including an outer receptacle, one or more partition inserts, and a cover, operatively interfitted relative to one another. The outer receptacle has a bottom wall and a side wall upstanding therefrom to an open upper top, and opposing handles are formed adjacent the open upper top. Each partition insert is sized to fit closely adjacent the outer receptacle walls, and has front and rear hooks that thereupon become operatively interfixed to the outer receptacle to hold each partition insert within the outer receptacle and to hold the outer receptacle side wall against outward flexture. Hinge structure between the cover and each partition insert movably supports the cover for opening and closing the outer receptacle. The outer receptacle side wall diverges away from the bottom wall to allow like outer receptacles to be compactly nested together for shipment before assembly, and the handles of adjacent outer receptacles engage before the side walls do to ease separation of adjacent outer receptacles for assembly.

10 Claims, 4 Drawing Sheets

PARTITIONED WASTE BASKET

BACKGROUND OF THE INVENTION

Recycling interest and efforts have reached the forefront of popular public movements, with the proposed separation of paper, aluminum, steel, etc., from the normal soft garbage or waste disposed of daily from homes and offices. However, a suitable economical easy-to-use reliable partitioned wastebasket has not yet been made available for home or office use.

SUMMARY OF THE INVENTION

This invention relates to an economical easy-to-use reliable partitioned wastebasket, that allows for the separate collection, accumulation and removal of different forms of waste, some being intended for recycling.

Basic objects of the present invention are to provide for a partitioned wastebasket comprised of multiple pieces or components, including an outer receptacle, one or more partition inserts, and a cover, where these components may be formed of plastic and simply shaped to allow for easy molded formation thereof, and where they are suited to cooperate in a snap-fit manner with one another suited to be easily and operatively assemblied together when needed, thereby allowing for the separated individual components to be compactly nested together and economically shipped for easy assembly then on site when needed.

Moreover, the present inventive partitioned wastebasket is suited to receive and hold a secondary plastic and/or paper bag within each of its defined separate compartments, to allow for independent removal of any of these bags, as it becomes filled, without then also removing the other bags. The partitioned wastebasket provides structure onto which the secondary bag can be secured, for both neatness and ease of removal, and this securing cooperation can be made without any hassle, effort or extra auxiliary clips or the like. A single cover overlies and closes all of the separate compartments.

To achieve these and other objects, the present invention may provide a partitioned wastebasket comprised of multiple component pieces including an outer receptacle, one or more partition inserts, and a cover, adapted to be operatively interfitted relative to one another. The outer receptacle has a bottom wall and a side wall upstanding therefrom to an open upper top, and opposing handles are formed adjacent the open upper top. Each partition insert has front and rear hooks, and is sized to be inserted into the outer receptacle and to fit closely adjacent the outer receptacle walls, and thereupon the hooks are operatively interfixed to the outer receptacle, operable to hold each partition insert within the outer receptacle and to hold the outer receptacle side wall against outward flexture. The cover has a peripherial edge sized to extend outwardly generally beyond the outer receptacle open upper top, and hinge means on the cover and each partition insert are operatively interfitted and cooperate with one another to movably support the cover for opening and closing the outer receptacle.

BRIEF DESCRIPTION OF THE DRAWINGS

Further objects, advantages and features of the present invention will appear from the following disclosure and description, including as a part thereof the accompanying drawings, in which.

DETAILED DESCRIPTION OF ILLUSTRATED EMBODIMENTS

Figure 3:
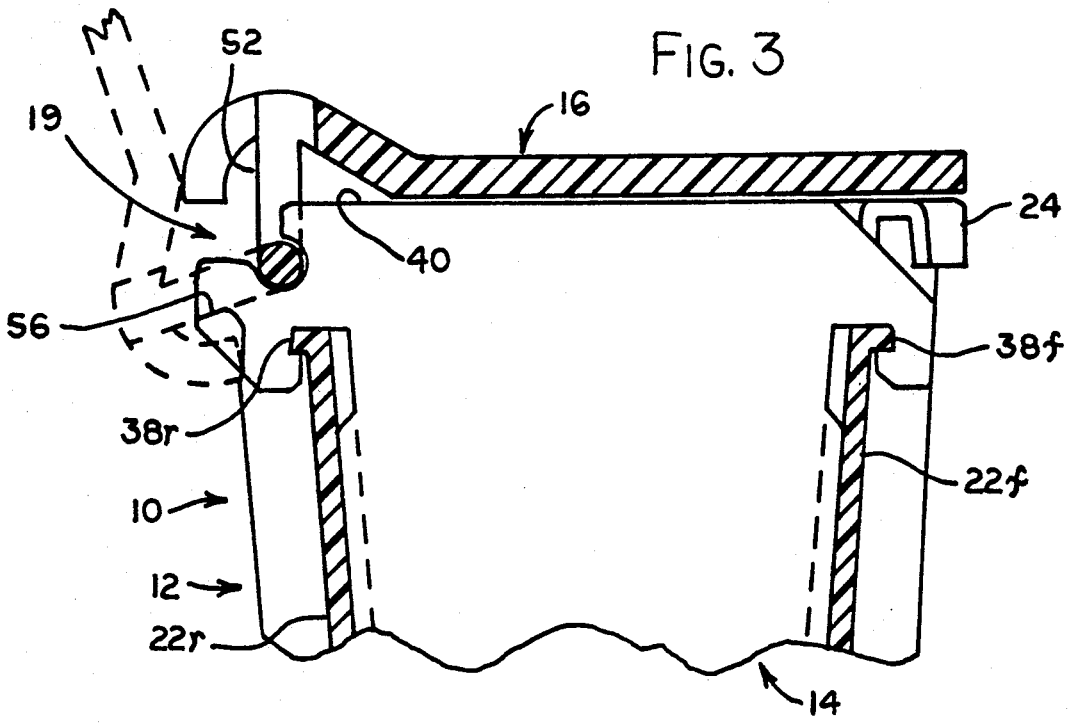
FIG. 3 is a sectional views as seen generally from the section line 3—3 in FIG. 2.
Figure 2:
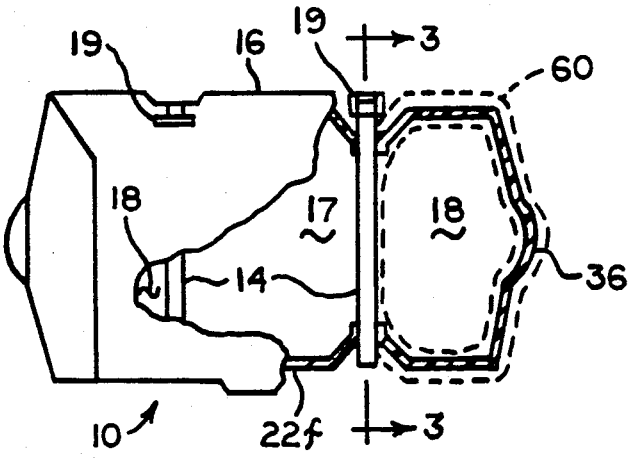
FIG. 2 is a top plan view of the partitioned wastebasket apparatus of FIG. 1, again partly broken away for clarity of disclosure.
Figure 1:
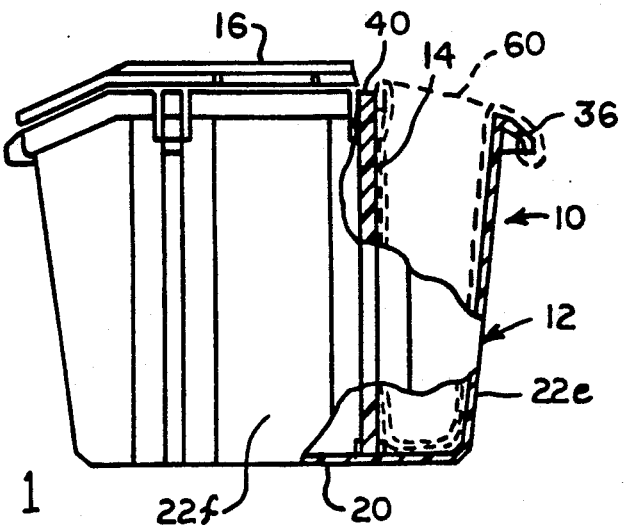
FIG. 1 is a front elevational view, partly broken away for clarity of disclosure, of one embodiment of a partitioned wastebasket apparatus comprising the subject invention.
Figure 7:
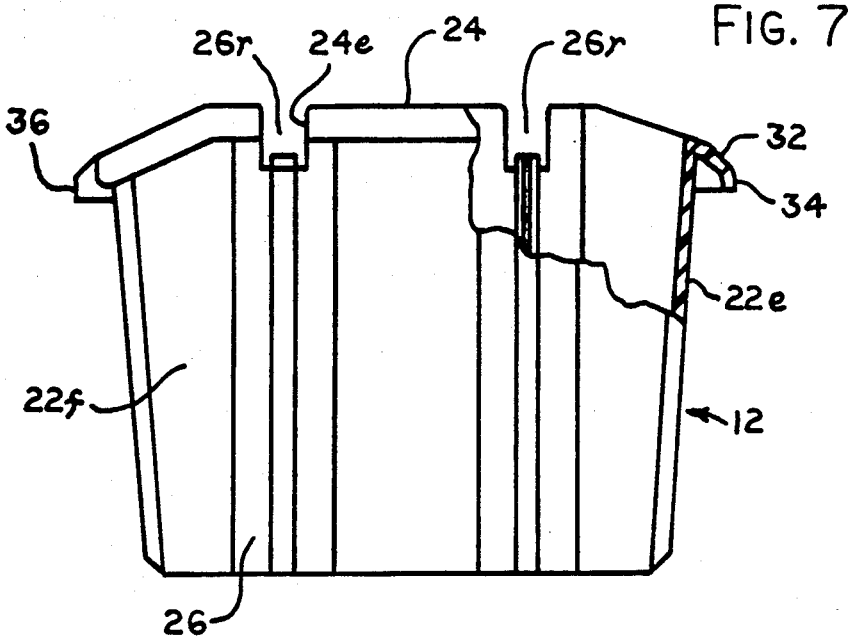
FIG. 7 is a front elevational view of an outer receptacle used in the partitioned wastebasket of FIGS. 1-3, again partly broken away for clarity of disclosure.
Figure 6:
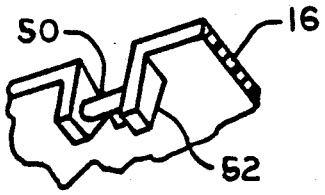
FIG. 6 is a fragmentary perspective view of the hinge pin as seen generally from the underside of the cover of FIG. 4.
Figure 5:
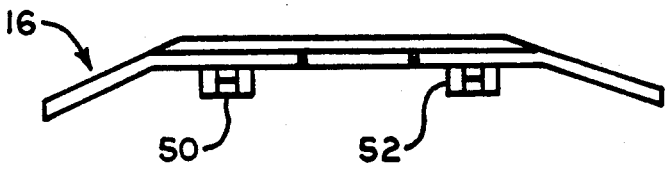
FIG. 5 is a front elevational view of the cover of FIG. 4.
Figure 4:
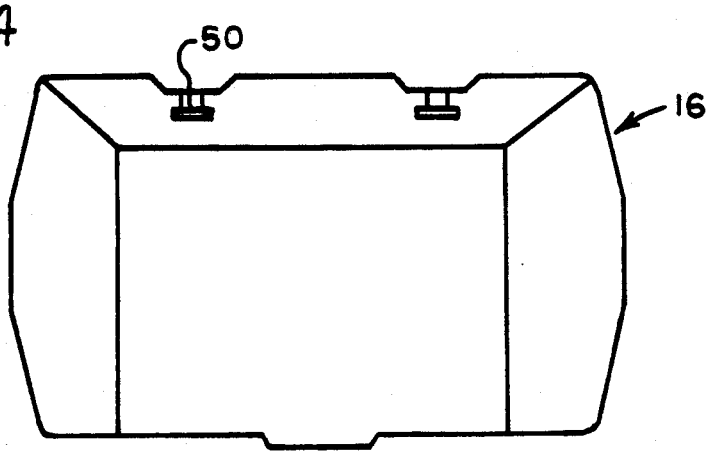
FIG. 4 is a top plan view of a cover used in the partitioned wastebasket of FIGS. 1-3.

The illustrated partitioned wastebasket 10 (FIGS. 1-3) is formed of multiple component pieces, including an outer receptacle 12, one or more similar partition inserts 14, and a cover 16, interfitted relative to one another to define a central compartment 17 and a pair of end compartments 18 respectively adjacent opposite sides of the central compartment 17. Hinge means 19 pivots the cover 16 between closed and opened positions relative to the outer receptacle 12. When the cover is opened, the partitioned wastebasket 10 allows a user to deposit three different forms of waste in the three separated compartments 17 and 18. The different wastes, for example including normal disposable kitchen waste and possibly two forms of recyclable waste can thus be separately and independently collected and accumulated in and removed from the partitioned wastebasket 10.

Concerning details of the construction of the partitioned wastebasket 10, the outer receptacle 12 is wider in one lateral direction than in the other, and has a bottom wall 20 and front, rear and end side walls **22*f*, 22*r* and 22*e* respectively upstanding therefrom to an open upper top 24**. The wider opposed front and rear side walls, 22*f* and 22*r* respectively, are extended somewhat parallel to each other between the narrow opposed end side walls 22*e*, except being angled or necked together to closer generally opposed proximity at two laterally spaced medial regions 26. Near and at these closer proximity medial regions 26, the open upper top 24 of the outer receptacle 12 is discontinued, as at recess 26*r*.

Figure 11:
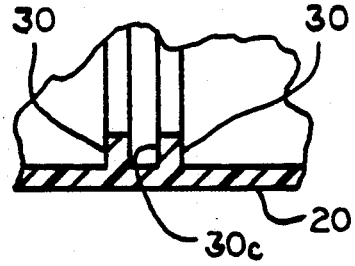
FIGS. 9, 10 and 11 are fragmentary sectional views as seen generally from the section lines 9—9, 10—10 and 11—11 respectively in FIG. 8.
Figure 10:
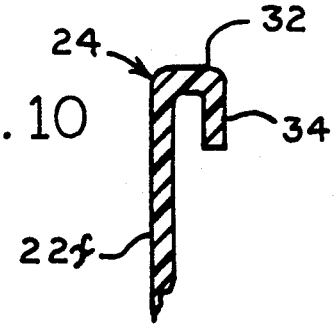
Figure 9:
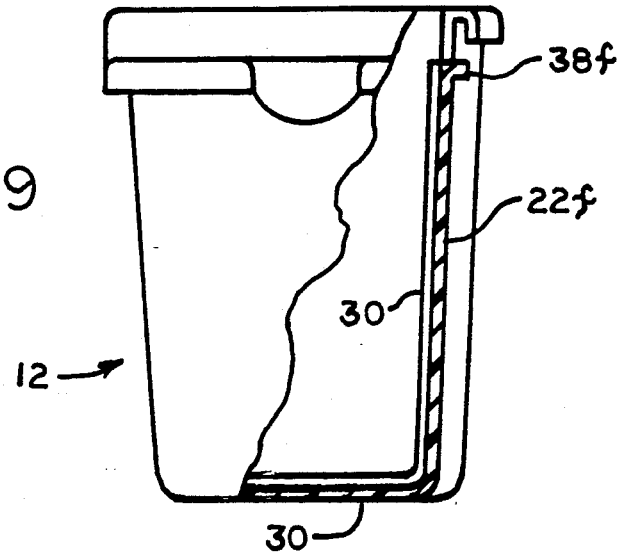
Figure 8:
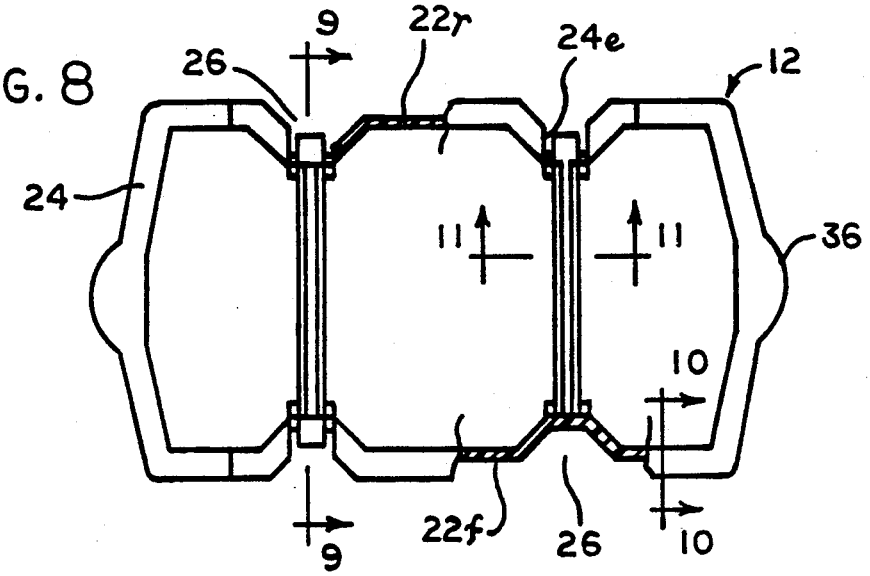
FIG. 8 is a top plan view of the outer receptacle of FIG. 7, again partly broken away for clarity of disclosure.

The partition inserts 14 cooperate with the outer receptacle 12 at these closer proximity medial regions 26 to define the three-compartments 17 and 18. To stablize each partition insert 14 against lateral movement in the outer receptacle 12, opposed pairs of track guides 30 (see FIG. 11) extended inwardly from the front and rear side and bottom walls, 22*f*, 22*r* and 20 respectively, define guide channel 30*c* suited to receive and strattle each partition insert. The guides 30 also structurally reinforce the respective walls.

The upper top 24 of the outer receptacle 12, almost completely around the perimeter, is rolled over providing web 32 and lip 34, again for structurally reinforcing the respective walls. The web 32 and lip 34 are reshaped somewhat at each end wall 22*e* to form opposed handles 36. Outturned flanges 38*f* and 38*r* are formed off the top of the opposed front and rear side walls 22*f* and 22*r* respectively at the medial regions 26; and these outturned flanges are located at the recess 26*r* below the open upper top 24 of the outer receptacle 12.

Figure 14:
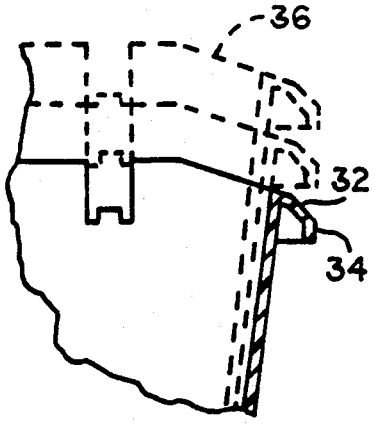
FIG. 14 is a fragmentary front elevational view, again partly broken away for clarity of disclosure, of several like outer receptacles, used in forming the partitioned wastebasket of FIGS. 1-3, illustrated in a stacked arrangement.
Figure 13:
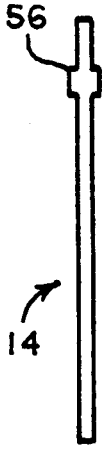
FIG. 13 is a rear elevational view of the partition insert of FIG. 7.

The outer receptacle side walls 22*f*, 22*r* and 22*e* in the vertical direction between the bottom wall 20 and the open upper top 24 overall are generally straight but are outwardly drafted, to allow for nested stacking of several like outer receptacles 12 (see FIG. 14) for economical shipment of these compactly arranged components to the market or end user. To keep the adjacent receptacles of the nested stack from becoming bound together, the respective handles 36 thereof are sized to engage one another before the adjacent respective side walls 22*f*, 22*r* and 22*e* thereof become snuggly engaged.

Figure 12:
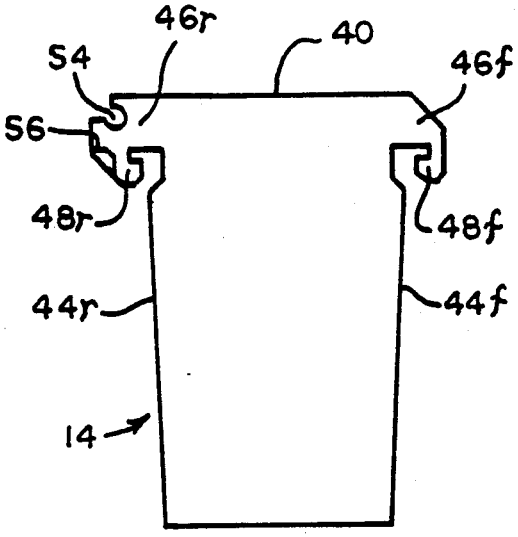
FIG. 12 is a side elevational view of a partition insert used in the partitioned wastebasket of FIGS. 1-3.

The partition insert 14 (see FIG. 12) has generally opposed top and bottom edges 40 and 42, and slightly angled front and rear side edges 44*f* and 44*r* (to match the draft of the outer receptacle front and rear side walls 22*f* and 22*r* respectively). Front and rear corner extensions 46*f* and 46*r* respectively, between the top and respective side edges, are contoured to provide front and rear hooks 48*f* and 48*r*, each hook having an inwardly projected tab formed thereon spaced below the top edge 40 and being open somewhat downwardly and inwardly.

The partition insert 14 is sized to be inserted into the outer receptacle 12 and to fit with its side and bottom edges 44*f*, 44*r* and 42 laterally contained within the guide channels 30*c* on the side and bottom walls 22*f*, 22*r* and 20. As so positioned, the top edge 40 lines up vertically even with the open upper top 24 of the outer receptacle 12, and the front and rear extensions 46*f* and 46*r* respectively fit in the recesses 26*r* with lateral clearances from the adjacent interrupted side wall edge portions 24*e*.

Each partition insert 14 is adapted to be operatively interfitted relative to the outer receptacle 12, and the cover 16 is adapted to be operatively interfitted relative to the outer receptacle 12 via the partition inserts 14.

To provide for this, the partition insert 14 behind the hooks 48*f* and 48*r* are relieved, allowing slight inward flexture of the front and rear side walls 22*f* and 22*r* respectively; and the hooks 45*f* and 45*r* have angled bottom lead edges, that ride the hooks over the outturned flanges 38*f* and 38*r* on the front and rear side walls. The partition insert, with the hooks overlying beyond the outer receptacle front and rear side walls, precludes outward flexture thereof; and with the hooks underlying the outturned flanges, is precluded from being vertically withdrawn from the outer receptacle 12.

Spaced pins 50 are formed on the cover 16 adjacent the rear peripherial edge, each pin being slightly spaced from the main plane of the cover body on arms 52. Each partition insert 14 has in its rear extension 46*r* an upwardly open recess 54, and the cover pins 50 are sized to fit operatively in these open recesses, to define together the hinge means 19 movably supporting the cover 16 for opening and closing movement relative to the outer receptacle 12. Widened shoulders 56 on each rear extension 46*r* adjacent the upwardly open recess 50 are engaged by the arms 54 when the cover 16 is fully opened, operable to hold the cover as so opened. The cover 16 is sized to have its peripherial edge extend outwardly beyond the outer receptacle open upper top 24, effective to overlie and close the outer receptacle 12.

The separate compartments 17 and 18 of the partitioned wastebasket 10 can hold the waste directly, or more commonly can hold a secondary plastic or paper bag which in turn directly holds the waste. For this reason, the compartments would preferably be sized to receive a somewhat conventional secondary bag (such as a plastic waste bag 60 shown in phantom in FIGS. 1, 2 and 16), whereby the open top of the bag could be backfolded and stretched over the open upper top 24 of the outer receptacle 12. The lateral clearance between each partition insert 14 at the front and rear extensions 46*f* and 46*r* and the adjacent outer receptacle wall structure, allows the backfolded secondary bag 60 to be contained at the edge portion 24*e* and span freely across its compartment adjacent the partition insert.

Figure 15:
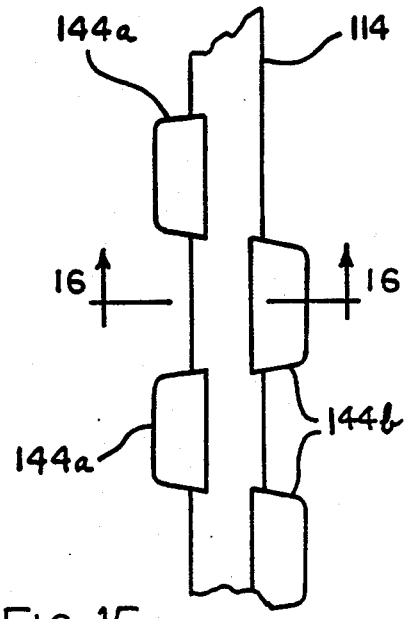
FIG. 15 is a top plan view of an alternative embodiment of a partition insert that can be used in the disclosed partitioned wastebasket.
Figure 16:
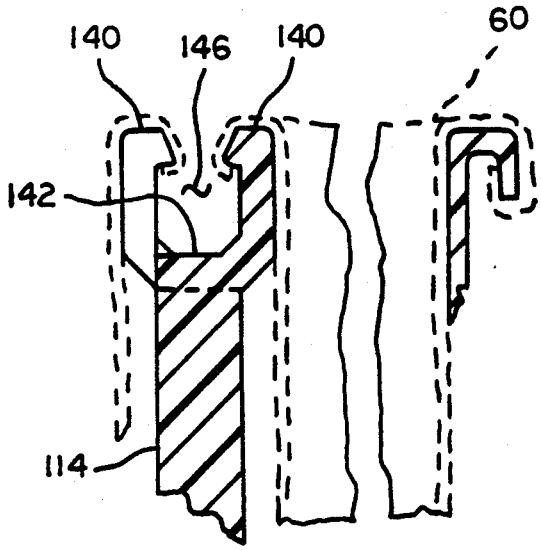
FIG. 16 is an elevational sectional view of a partitioned wastebasket using the partition insert of FIG. 15, showing how secondary trash bags may be supported thereon, as taken generally from section line 16—16 in FIG. 15.

An alternative partition insert 114 is illustrated in FIGS. 15 and 16, having the top edge 140 interrupted and defined by two rows of laterally separated tabs 144*a* and 144*b*, disposed immediately adjacent respectively the defined adjacent compartments. The top edge 140 of the tabs would generally line up vertically with the open upper top 24 of the outer receptacle 12, and the bottom end of the tabs 142 would be spaced vertically lower than that, with a lateral space 146 existing between the separate rows 144*a* and 144*b*.

Thus, the secondary bag 60 could be backfolded and interlocked over the tabs and fitted into the space 146 as it is stretched across its compartment adjacent the partition insert 14, the bag being held vertically and horizontally by the partition insert 114.

An economical and easily used partitioned wastebasket 10 has been disclosed, being particularly suited for the separate collection, accumulation and removal of different forms of waste, some possibly being intended for recycling. The interfitted multiple components comprising the outer receptacle, the partition inserts and cover, allow for economical manufacture of the individual components, such as by molding them of a durable plastic, and for their on-site assembly to form the illustrated partitioned wastebasket 10 at the market or end user's place as needed. While a three compartment unit has been illustrated, if only one partition insert 14 were used, only a two compartment wastebasket would be defined. The shapes or sizes of the components and/or compartments could be varied also.

Thus, while only specific embodiments of the invention has been illustrated, it will be apparent that slight variations may be made therefrom without departing from the inventive concept. With this in mind, it is intended that the invention be limited only by the following claims.

What is claimed as our invention is:

1. A partitioned wastebasket, comprising the combination of multiple component pieces including an outer receptacle, a pair of partition inserts, and a cover operatively interfitted relative to one another;

said outer receptacle having a bottom wall and front, rear and side walls upstanding therefrom to an open upper top, and two pairs of outturned flanges formed laterally spaced apart on the front and rear walls adjacent the open upper top and medially between the side walls;

said partition inserts being generally planar and sized to be fit snuggly within the outer receptacle to define three separated compartments within the outer receptacle, and each partition insert having front and rear inturned hooks thereon operable to be snapped over and become mechanically interlocked with a respective pair of the receptacle flanges as the partition inserts are fitted into the outer receptacle, to hold the partition inserts within the outer receptacle and to hold the outer receptacle front and rear walls against outward flexture; and said cover being sized to extend outwardly beyond the outer receptacle open upper top to cooperate with and close the outer receptacle and the defined three compartments simultaneously, and the cover and each partition insert having cooperating rear hinge means to movably pivot the cover for movement about a laterally extended axis disposed transverse to the partition inserts for simultaneously opening and closing the three compartments.

2. A partitioned wastebasket according to claim 1, wherein the hinge means including arms supported off of the cover and pin means on the arms cooperating rotatably within recess means formed on the partition inserts, and the partition inserts having shoulders generally adjacent the rear hooks, engaged by the arms when the cover is pivoted to be fully opened, to limit the extent the cover can be opened.

3. A partitioned wastebasket according to claim 1, wherein the partition insert engaging the outer receptacle wall on the side thereof opposite the flanges and each partition insert in proximity behind the hooks being relieved, allowing slight inward flexture of the front and rear side wall flanges upon the partition insert being fitted into the outer receptacle or upon the partition insert being intentionally removed from the outer receptacle.

4. A partitioned wastebasket according to claim 3, wherein the hooks having upwardly and inwardly angled bottom lead edges, for riding the hooks over the outturned flanges on the front and rear side walls, upon the hooks being snapped over the receptacle flanges as the outer receptacle walls are inwardly flexed and as the partition insert are fitted into the outer receptacle.

5. A partitioned wastebasket according to claim 1, wherein said outer receptacle front and rear walls being comprised of substantially planar major portions and two pairs of laterally spaced apart minor generally V-angled medial portions disposed in closer proximity to one another, and said pairs of outturned flanges being formed generally at these medial portions and the partition inserts cooperating with the outer receptacle at these medial portions.

6. A partitioned wastebasket according to claim 5, wherein the open upper top of the outer receptacle front and rear walls generally at said V-angled medial protions being vertically and laterally interrupted to define lateral clearances immediately adjacent each interlocked partition insert and between the adjacent outer receptacle walls, and the partition inserts having tabs with top edges lining up vertically even with the uninterrupted open upper top of the outer receptacle.

7. A partitioned wastebasket according to claim 6, wherein each insert's tabs are provided into two rows of laterally separated tabs respectively disposed immediately adjacent said defined adjacent compartments and providing a lateral space between the separate rows, each row of said tabs presenting a top edge generally lined up vertically with the uninterrupted open upper top of the outer receptacle, operable to have secondary bags fitted in the defined respective compartments each bag having an open top backfolded and interlocked vertically and horizontally over the open upper top of said outer receptacle and over only the adjacent row of tabs as the bag crosses its respective compartment immediately adjacent the partition insert for vertically and horizontally holding the bag relative to the outer receptacle and partition insert.

8. A partitioned wastebasket according to claim 6, wherein said outer receptacle at each of said medial portions having opposed pairs of guides extended inwardly from the front, rear and bottom walls each pair defining a channel thereon; and each partition insert having side and bottom edges sized to be inserted into a respective outer receptacle channel and be laterally contained therewithin.

9. A partitioned wastebasket according to claim 8, wherein the open upper top of the outer receptacle providing laterally extended web and lip means, and the web and lip means being reshaped at each of the opposed side walls to form the opposed handles; said outer receptacle front, rear and side walls being generally straight and outwardly drafted in the direction between the bottom wall and the open upper top, operable to allow like outer receptacles to be compactly nested together for shipment before assembly of the component pieces together; and the handles of adjacent nested outer receptacles being sized to engage one another before the front, rear or side walls thereof engage in a flush manner to allow without binding easy separation of adjacent nested outer receptacles.

10. A partitioned wastebasket according to claim 1, wherein said outer receptacle front and rear walls being comprised of substantially planar major portions and two pairs of laterally spaced apart minor generally V-angled medial portions disposed in closer proximity to one another, opposed pairs of guides at each of said medial portions extended inwardly from the front, rear and bottom walls each pair defining a channel thereon; each partition insert having side and bottom edges sized to be inserted into a respective outer receptacle channel and be laterally contained therewithin; and the open upper top of the outer receptacle front and rear walls generally at said V-angled medial portions being interrupted to define lateral clearances between each interlocked partition insert and the adjacent outer receptacle walls, and the partition inserts having two rows of laterally separated tabs respectively disposed immediately adjacent said defined adjacent compartments and providing top edges lining up vertically even with the uninterrupted open upper top of the outer receptacle, operable to have secondary bags independently fitted in and removed from the defined respective compartments, each bag having an open top backfolded and interlocked vertically and horizontally over only the adjacent row of tabs as the bag crosses its respective compartment immediately adjacent the partition insert for vertically and horizontally holding the bag relative to the partition insert.

* * * * *